US010305238B2

(12) United States Patent
Ding

(10) Patent No.: US 10,305,238 B2
(45) Date of Patent: May 28, 2019

(54) COMBINED POWER SOCKET FOR ARTIFICIAL CHRISTMAS TREE

(71) Applicant: Feng Ding, Xiaogan (CN)

(72) Inventor: Feng Ding, Xiaogan (CN)

( * ) Notice: Subject to any disclaimer, the term of this patent is extended or adjusted under 35 U.S.C. 154(b) by 0 days.

(21) Appl. No.: 15/721,445

(22) Filed: Sep. 29, 2017

(65) Prior Publication Data

US 2018/0269641 A1 Sep. 20, 2018

(30) Foreign Application Priority Data

Mar. 17, 2017 (CN) ..... 2017 2 0264058 U

(51) Int. Cl.

| | |
|---|---|
| ***H01J 5/56*** | (2006.01) |
| ***H01R 33/92*** | (2006.01) |
| ***A47G 33/08*** | (2006.01) |
| ***H01R 13/04*** | (2006.01) |
| ***H01R 24/86*** | (2011.01) |
| ***H01R 31/02*** | (2006.01) |
| *A47G 33/06* | (2006.01) |

(52) U.S. Cl.

CPC ..... *H01R 33/92* (2013.01); *A47G 33/08* (2013.01); *H01R 13/04* (2013.01); *H01R 24/86* (2013.01); *H01R 31/02* (2013.01); *A47G 33/06* (2013.01); *A47G 2033/0827* (2013.01)

(58) Field of Classification Search

CPC ..... H01R 25/003; H01R 33/22; H01J 5/50; F21W 2121/00; A47G 33/06; F21S 4/001

USPC ..... 439/214, 612, 613; 362/122, 123, 362/249.18, 249.19, 806

See application file for complete search history.

(56) References Cited

U.S. PATENT DOCUMENTS

| | | | | |
|---|---|---|---|---|
| 2,875,421 A * | 2/1959 | Jordan | H01R 25/00 174/68.2 |
| 3,752,407 A * | 8/1973 | Baugh | F21S 4/10 362/123 |
| 3,970,834 A * | 7/1976 | Smith | A47G 33/06 248/435 |
| 4,516,193 A * | 5/1985 | Murphy | F21V 21/088 362/123 |
| 5,150,963 A * | 9/1992 | Hill | F21S 4/10 362/101 |
| 5,776,559 A * | 7/1998 | Woolford | F21S 4/10 362/123 |
| 6,883,951 B2 * | 4/2005 | Wu | A47G 33/06 362/123 |
| 7,052,156 B2 * | 5/2006 | Primeau | A47G 33/06 362/123 |
| 7,144,610 B1 * | 12/2006 | Estes | A47B 97/00 428/19 |
| 7,325,942 B2 * | 2/2008 | Chang | F21V 17/06 362/122 |

(Continued)

*Primary Examiner* — Thanh Tam T Le
(74) *Attorney, Agent, or Firm* — LeClairRyan

(57) ABSTRACT

A combined power socket for artificial Christmas trees having a pair of sockets set in a ring structure capable of being sleeved on an outer surface of a rod or tube The pair of sockets can be combined as a group, and can be connected with additional power sockets to achieve interconnection, at the same time through the power supply connector leads from each combination type power socket for external devices, such as lamp series power supply, which has the advantages of simpler structure, more convenient connections to external devices.

10 Claims, 4 Drawing Sheets

(56) References Cited

U.S. PATENT DOCUMENTS

| | | | | |
|---|---|---|---|---|
| 8,454,186 | B2 * | 6/2013 | Chen | F21V 21/002 362/123 |
| 8,870,404 | B1 * | 10/2014 | Chen | A47G 33/06 362/123 |
| 8,876,321 | B2 * | 11/2014 | Chen | F21V 33/00 362/123 |
| 8,905,771 | B2 * | 12/2014 | Tsai | F21V 23/001 439/214 |
| 8,936,379 | B1 * | 1/2015 | Chen | F21V 21/002 362/249.19 |
| 9,044,056 | B2 * | 6/2015 | Chen | A41G 1/005 |

* cited by examiner

COMBINED POWER SOCKET FOR ARTIFICIAL CHRISTMAS TREE

TECHNICAL FIELD

The utility model relates to power sockets, and in particular, to a combined power socket for an artificial Christmas tree, wherein the combined power socket can be interconnected to increase the quantity of sockets.

BACKGROUND

String lights are broadly used in indoor and outdoor Christmas tree decorations as necessary ornamentations for festival celebration. To decorate a large Christmas tree, generally 5 to 10 string lights or more will be needed. At present, a power socket for powering the string lights is provided with a plurality of jacks adapted to string light plugs. Generally, the quantity of the jacks is two to ten; and thus merely two to ten string lights can be connected. One or more power sockets need to be provided additionally if more string lights are needed; and therefore, one or more additional main sockets need to be used. One wall of a regular household is generally provided with only one mains supply socket; and it easily occurs that the mains supply socket is insufficient or an additional power strip needs to be configured, thus being inconvenient in use. In the process of assembling, a worker will need to climb up and down for wiring; therefore, the assembling is inconvenient and unsafe.

As a result, a combined electric connection terminal fixed in a Christmas tree trunk emerges, e.g., an electric connector disclosed in Chinese Utility Model Patent No. 20152107394.7 filed on Dec. 24, 2015. Electric connection terminals, when combined and fixed in the tree trunk, are also electrically connected to each other when an upper section and a lower section of the trunk are connected. However, wires of such electric connector all extend and connect inside the trunk, thus having high assembling costs. Moreover, electric connection conditions cannot be observed in use, which causes a great safety risk.

A combined power socket disclosed in Chinese Utility Model Patent No. 201320289695.0 filed on May 24, 2013 can be sleeved on an outer circumference of a trunk and can implement electric connection when connecting the trunk parts. However, jacks of the combined power socket are all arranged on one socket body; therefore, the manufacturing process is complicated and improvement is needed.

SUMMARY

An objective of the utility model is to provide a combined power socket having a simple structure.

A combined power socket, comprising a first socket and a second socket matching each other, wherein the first socket and the second socket are both in an annular structure capable of being sleeved on an outer surface of a rod or tube; a plurality of jacks are formed on a first end of one of the first socket and the second socket, conductors being arranged therein; a plurality of conductive pins corresponding to the plurality of jacks are formed on a first end of the other of the first socket and the second socket; and wire outlets communicating with the interiors of the sockets are formed on outer sidewalls or close to outer sidewalls of the first socket and the second socket; a first conductive contact is led and exposed from the wire outlet of one of the first socket and the second socket through a conductive wire, and a second conductive contact adapted to the first conductive contact or a power plug adapted to an external power socket is led and exposed from the wire outlet of the other of the first socket and the second socket through a conductor wire; and at least one power supply contact is further led and exposed from the wire outlet of at least one of the first socket and the second socket through a conductor wire.

Preferably, at least one of the first socket and the second socket is provided with blades extending outwards and are insertable into a ring of the other of the first socket and the second socket such that the first and second sockets may be detachably connected together.

As an implementation, the first socket comprises: an annular substrate; an annular inner wall and an annular outer wall perpendicular to the substrate from an inner circumference and an outer circumference of the substrate and extending toward a first side of the substrate; an annular cover plate connected to tail ends of the inner wall and the outer wall to seal a space enclosed by the substrate, the inner wall, and the outer wall; a plurality of blades extending from the inner wall toward a second side of the substrate; and a plurality of pillars extending from the substrate toward the second side of the substrate, wherein a plurality of through holes penetrating the substrate and two ends of each of the pillars are formed at positions corresponding to the plurality of pillars on the substrate to serve as the jacks. The conductors are inserted into the plurality of jacks from the first side of the substrate, and the conductors are electrically connected to the conductor wires led in from the wire outlets.

As an implementation, 4 blades are distributed uniformly and symmetrically; 4 jacks are also distributed uniformly and symmetrically, each jack is arranged between two adjacent blades, two jacks form a group, and conductors in jacks of the same group are electrically connected.

As an implementation, the conductor is a metal tube in a size matching an inner diameter of the jack, and ends of metal tubes in the jacks of the same group facing the cover plate are electrically connected through an arc-shaped conductive tube, conductive rod, or conductive metal wire.

Preferably, the second side of the substrate is further provided with a ring body connecting outer surfaces of the pillars and the blades, and a height of the ring body is the same as a height of the pillars but less than a height of the blades, such that the blades exceed the ring body and extend farther toward the second side of the substrate.

As an implementation, the second socket comprises: an annular second substrate; an annular second inner wall and an annular second outer wall perpendicular to the substrate from an inner circumference and an outer circumference of the second substrate and extending toward a first side of the second substrate; an annular second cover plate connected to tail ends of the second inner wall and the second outer wall to seal a space enclosed by the second substrate, the second inner wall, and the second outer wall; a plurality of second blades extending from the second inner wall toward a second side of the second substrate; and a plurality of second pillars extending from the second substrate toward the second side of the second substrate, wherein a plurality of second through holes penetrating the second substrate and two ends of each of the second pillars are formed at positions corresponding to the plurality of second pillars on the second substrate. The plurality of conductive pins are inserted into the second through holes and extend from tail ends of the second pillars, and the conductive pins are electrically connected to the conductor wires led in from the corresponding wire outlets.

As an implementation, 4 second blades are distributed uniformly and symmetrically; 4 second pillars are also distributed uniformly and symmetrically, and each second pillar is arranged opposite to the second blade.

As an implementation, the second side of the second substrate is further provided with a second ring body connecting outer surfaces of the second pillars and the second blades, and a height of the second ring body is the same as a height of the second pillars but less than a height of the second blades, such that the second blades exceed the second ring body and extend farther toward the second side of the second substrate.

As an implementation, the first socket is sleeved on a lower-layer section of a trunk of the Christmas tree, the second socket is sleeved on an upper-layer section of the trunk of the Christmas tree, and the first socket and the second socket are electrically connected when the upper-layer section and the lower-layer section are connected together.

The first socket and the second socket of the combined power socket for an artificial Christmas tree according to the utility model are in pair, and can be connected to each other or connected to another pair to implement interconnection, so as to increase the quantity of sockets. Meanwhile, a power supply contact led and exposed from each pair of the combined power socket powers the string lights; therefore, the structure is simpler and the string lights are connected more conveniently.

DETAILED DESCRIPTION

Figure 1:
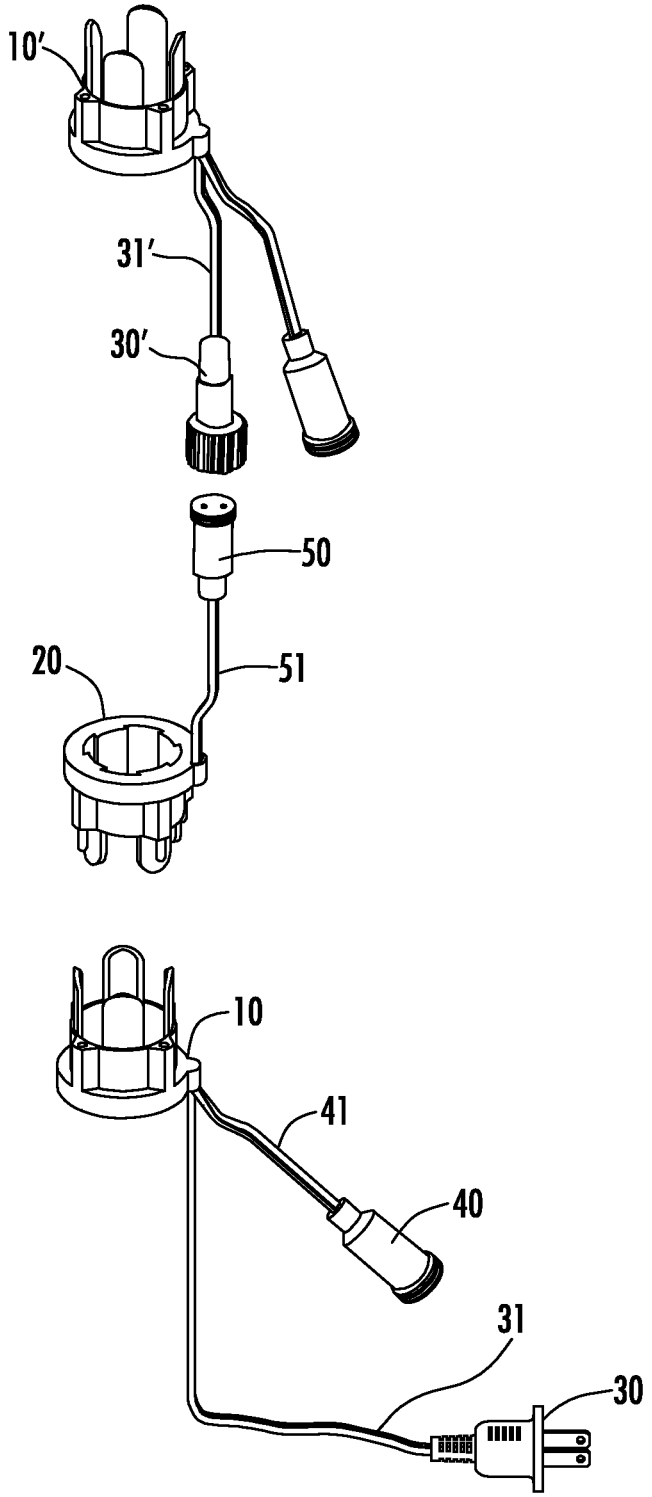
FIG. 1 is a schematic structural diagram of a combined power socket according to an embodiment of the utility model.
Figure 2:
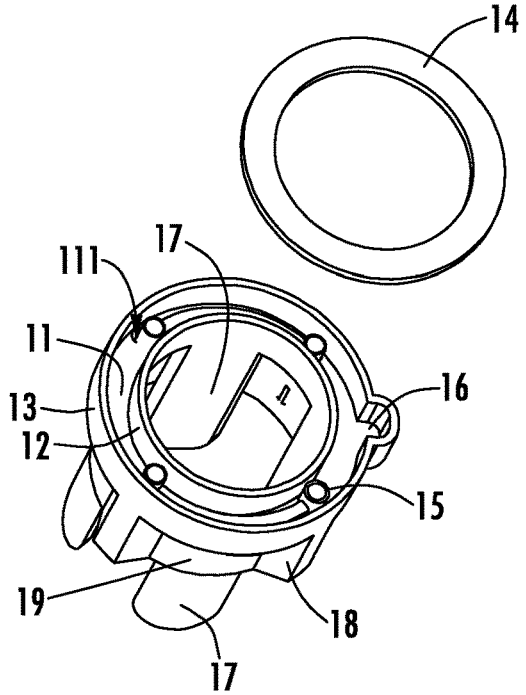
FIG. 2 is an exploded view of a first socket in FIG. 1.
Figure 3:
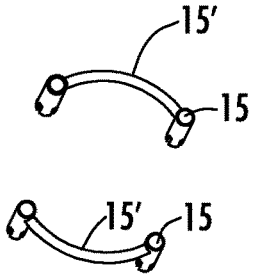
FIG. 3 is a schematic structural diagram of a conductor of the first socket in FIG. 2.

The combined power socket according to the utility model will be described below in further detail with reference to specific embodiments and the accompanying drawings.

As shown in FIG. 1 to FIG. 5, in an embodiment of the present invention, a combined power socket includes a first socket 10 and a second socket 20 that match each other. The first socket 10 and the second socket 20 are both in an annular structure capable of being sleeved on an outer surface of a rod or tube (e.g., a Christmas tree trunk); therefore, the first socket 10 and the second socket 20 are also electrically connected together when two rods or tubes having end portions with the first socket 10 and the second socket 20 sleeved respectively are connected together by insertion.

In this embodiment, the first socket 10 mainly includes an annular substrate 11, an annular inner wall 12 and an annular outer wall 13 perpendicular to the substrate from an inner circumference and an outer circumference of the substrate 11 and extend toward a first side of the substrate, and an annular cover plate 14 connected to tail ends of the inner wall 12 and the outer wall 13. A receiving space for receiving conductor wires and conductors 15 is enclosed by the substrate 11, the inner wall 12, and the outer wall 13. Moreover, the substrate 11 is integrally annular-shaped. A boss further extends outwards from the outer circumference of the substrate; and the outer wall 13 protrudes outwards accordingly. The annular-shaped cover plate 14 seals the annular-shaped space for receiving the conductors 15, such that the boss and the outwardly protruded outer wall 13 form a wire outlet 16 for conductor wires. Moreover, an exit direction of the wire outlet 16 faces the first side of the substrate 11.

The first socket 10 further includes a plurality of blades 17 that extend from the inner wall 12 toward a second side of the substrate 11 opposite to the first side, and a plurality of pillars 18 extending from the substrate 11 toward the second side of the substrate. A plurality of through holes penetrating the substrate 11 and two ends of each of the pillars 18 are formed on the substrate 11 at positions corresponding to the plurality of pillars 18 to serve as jacks 111. In this embodiment, there are 4 blades 17 distributed uniformly and symmetrically, and are approximately rectangular with arc-shaped tail ends. There are also 4 jacks 111 distributed uniformly and symmetrically, each jack 111 is arranged between two adjacent blades 17, two jacks 111 form a group, and conductors 15 in jacks of the same group are electrically connected.

In this embodiment, the conductor 15 is a metal tube in a size matching an inner diameter of the jack 111, and ends of metal tubes in the jacks of the same group facing the cover plate 14 are electrically connected together through an arc-shaped conductive tube, conductive rod, or conductive metal wire 151. Moreover, the other end of the conductor 15 is provided with a plurality of slots such that the end portion is claw-shaped to facilitate insertion of a corresponding rod-shaped pin to implement electric connection. In this embodiment, the other end of the conductor 15 does not extend to the outside of the jack 111.

A conductor wire 31 having one end connected to a power plug 30 adapted to an external power socket enters a receiving chamber of the first socket 10 from the wire outlet 16 to be electrically connected to the conductor 15. Another one or more conductor wires 41 each having one end connected to a power supply contact 40 also enter the receiving chamber of the first socket 10 from the wire outlet 16 to be electrically connected to the conductor 15. The power supply contact 40 is adapted to an electric connection terminal of external electric equipment such as string lights of a Christmas tree.

Moreover, the second side of the substrate 11 is further provided with a ring body 19 that connects outer surfaces of the pillars 18 and the blades 17; and the height of the ring body 19 is the same as the height of the pillars 18 but less than the height of the blades 17, such that the blades 17 exceed the ring body 19 to extend farther toward the second side of the substrate 11. The ring body 19 enhances the strength of the blades 17.

FIG. 1 further shows another first socket 10' used for expansion and having a structure substantially identical to that of the first socket 10. A unique difference between the first socket 10' and the first socket 10 lies in that a conductor wire 31' is connected to a first conductive contact 30' rather than to the power plug for external power source. In this embodiment, the first conductive contact 30' is a small-scale two-pin plug.

Figure 4:
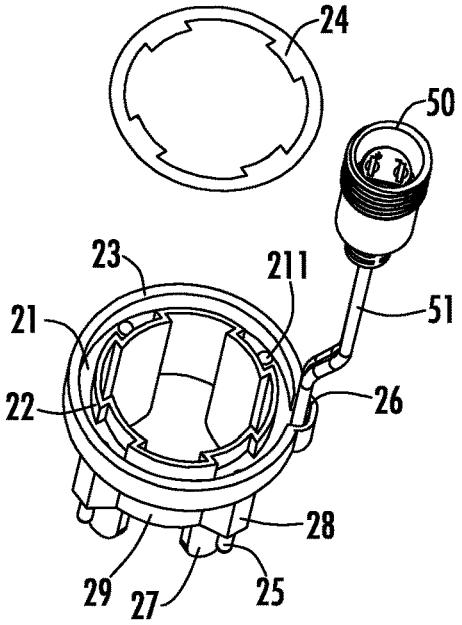
FIG. 4 is an exploded view of a second socket in FIG. 1.
Figure 5:
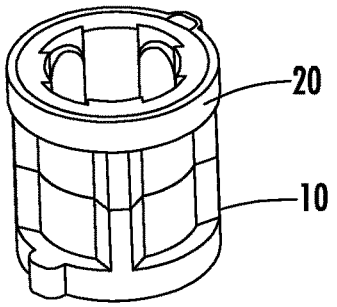
FIG. 5 is a schematic connection diagram of a first socket and a second socket according to Embodiment 3 of the utility model.

Please refer to FIG. 4 and FIG. 5 at the same time. The second socket 20 mainly includes an annular second substrate 21; an annular second inner wall 22 and an annular second outer wall 23 perpendicular to the second substrate from an inner circumference and an outer circumference of the second substrate 21 and extend toward a first side of the second substrate; and an annular second cover plate 24 connected to tail ends of the second inner wall 22 and the second outer wall 23. A receiving space for receiving conductor wires is enclosed by the second substrate 21, the second inner wall 22, and the second outer wall 23. Moreover, similar to the first socket 10, the second substrate 21 has a circular outer circumference. A boss further extends outwards from the outer circumference of the second substrate, and the second outer wall 23 protrudes outwards accordingly. The second cover plate 24 has a circular outer circumference and an inner circumference in a shape corresponding to the shape of the second substrate 21, and can seal the space for receiving conductor wires enclosed by the second inner wall 22 and the second substrate, such that the boss and the outwardly protruded outer wall 23 form a second wire outlet 26 for conductor wires. Moreover, an exit direction of the wire outlet 26 faces the first side of the second substrate 21.

The second socket 20 further includes a plurality of second blades 27 that extend from the second inner wall 22 toward a second side of the second substrate 21 opposite to the first side, and a plurality of second pillars 28 extending from the second substrate 21 toward the second side of the second substrate. A plurality of through holes 211 penetrating the second substrate 21 and two ends of each of the second pillars 28 are formed at positions corresponding to the plurality of second pillars 28 on the second substrate 21. In this embodiment, there are 4 second blades 27 distributed uniformly and symmetrically, and are approximately rectangular with arc-shaped tail ends. There are also 4 second pillars 28 (second through holes 211) distributed uniformly and symmetrically, and each second pillar 28 is arranged opposite to a second blade 27. Each through hole 211 is inserted with a conductive pin 25, and two through holes 211 form a group. After conductive pins 25 in through holes of the same group are electrically connected, they are used as an anode or a cathode to be electrically connected to a conductor wire 51 entering the receiving chamber of the second socket 20 from the second wire outlet 26. The other end of the conductor wire 51 located outside of the second socket 20 is connected to a second conductive contact 50 (a small-scale two-jack socket in this embodiment) adapted to a first conductive contact 30' of a first socket 10' used for expansion.

Moreover, the second side of the second substrate 21 is further provided with a second ring body 29 that connects outer surfaces of the second pillars 28 and the second blades 27; and the height of the second ring body 29 is the same as the height of the second pillars 28 but less than the height of the second blades 27, such that the second blades 27 exceed the second ring body 29 to extend farther toward the second side of the second substrate 21. The second ring body 29 enhances the strength of the second blades 27. Moreover, the conductive pin 25 extends outwards from the through hole 211 in the second pillar 28, but does not exceed the tail end of the second blade 27.

During use, the first socket 10 and the second socket 20 are connected together by insertion. The blades 17 and the second blades 27 are interlaced to be inserted only into inner sides of the ring body 19 and the second ring body 29. The ring body 19 and the second ring body 29 abut against each other. The conductive pins 25 are inserted into the jacks 111 and inserted into the claw-shaped end portions of the conductors 15 to implement electric connection. The first socket 10 and the second socket 20 are tightly connected together by frictional forces between the blades and the ring bodies. In this case, power input of the combined socket supplies power to the external merely by using the power supply contact 40. If the quantity of the power supply contacts 40 needs to be increased, the first conductive contact 30' of the first socket 10' used for expansion can be connected to the second conductive contact 50 of the second socket 20 by insertion.

In another embodiment, another one or more conductor wires each having one end connected to a power supply contact 40 can also enter the receiving chamber of the second socket 20 from the second wire outlet 16 to be electrically connected to the conductive pin 25. Therefore, the first socket 10 and the second socket 20 both have power supply contacts 40. It can be understood that two or more power supply contacts 40 can be provided on the first socket 10 and/or the second socket 20 as required.

It can also be understood that in order to prevent short circuit, electric connection polarity prompt marks should be arranged on the first socket 10 and the second socket 20.

In another embodiment, it is possible that the power supply contact 40 is merely arranged on the second socket 20; and the first socket is only provided with the power plug 30 or the first conductive contact 30'.

In another embodiment, the quantity of the blades in each socket can be adjusted to 2, 3, 4, or more according to the size of the combined power socket and requirements. The quantity of the jacks on the first socket can be merely 2. The jacks can be arranged oppositely or arranged close to each other. Accordingly, the quantity of the conductive pins can be merely 2. In another embodiment, the quantities of the jacks and the conductive pins can be set to be different as long as the quantity of the conductive pins is greater than the quantity of the jacks. In these embodiments, polarities of the conductive pins and polarities of the conductors in the jacks can be set as required.

In another embodiment, the positions of the wire outlets can be arranged on the outer sidewalls of the first socket and the second socket, such as the outer wall 13 and the second outer wall 23. The wire outlets can also be arranged on the cover plate 14 and the second cover plate 24, such that the outer circumferences of the substrate 11 and the second substrate 21 can be perfectly circular-shaped.

Figure 6:
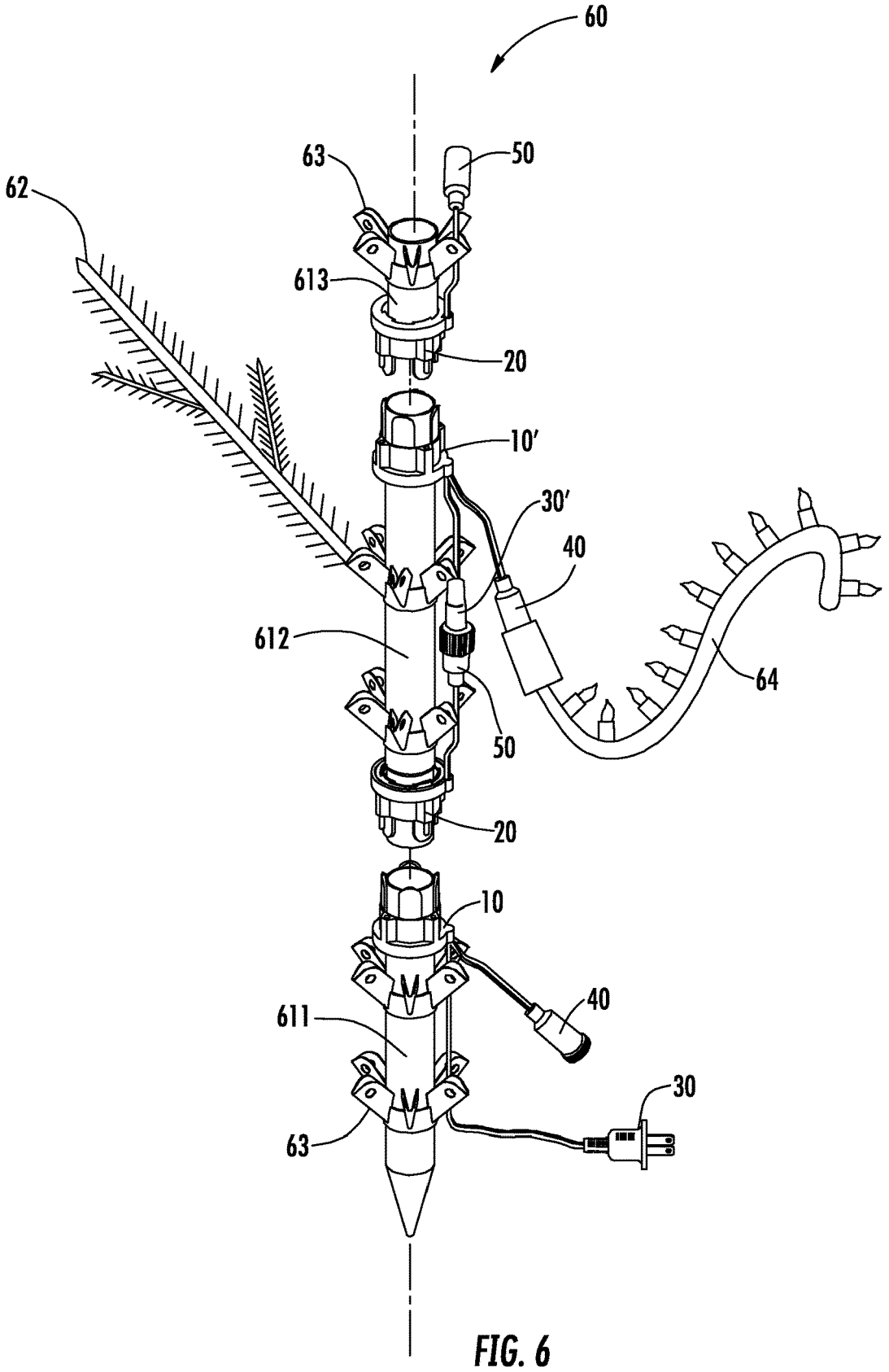
FIG. 6 is an exploded view of a combined power socket according to the utility model applied to a Christmas tree.
Figure 7:
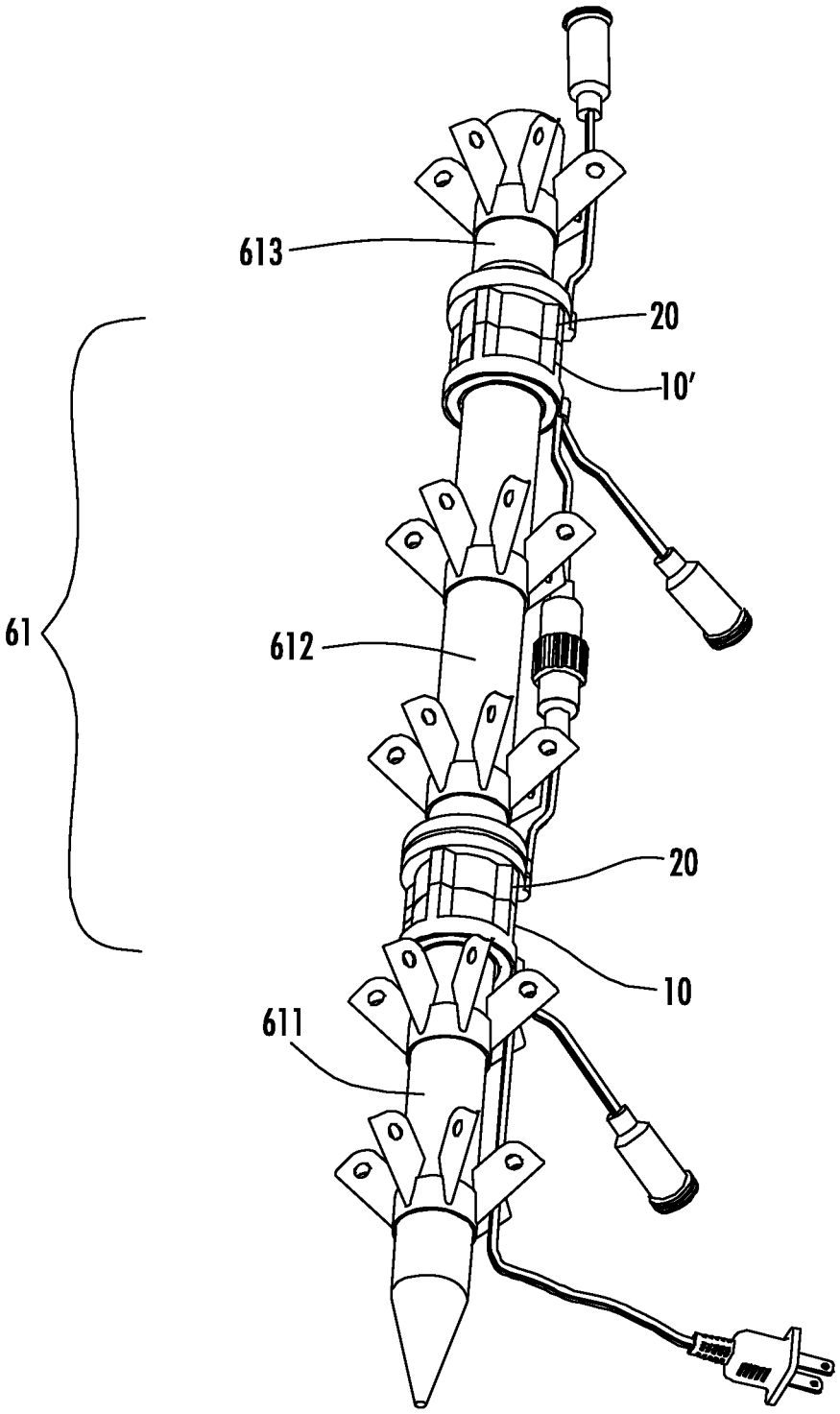
FIG. 7 is a schematic constitution diagram of a combined power socket according to the utility model applied to a Christmas tree.

FIG. 6 and FIG. 7 are schematic structural diagrams of a combined power socket according to the utility model applied to a Christmas tree. The Christmas tree 60 includes a three-section trunk 61, a bracket 63 sleeved on the trunk 61 and used for connecting branches 62, and string lights 64 hung on the branches 62. A first socket 10 is sleeved (by interference fitting or fixed connection with a screw) onto an outer circumference of an upper end of a lower-section trunk 611. A second socket 20 is sleeved onto an outer circumference of a lower end of a middle-section trunk 612; and a first socket 10' used for expansion is sleeved onto an outer circumference of an upper end of the middle-section trunk 612. Another second socket 20 is sleeved onto an outer circumference of a lower end of an upper-section trunk 613. When the three trunk sections are inserted to one another to be connected together, end portions of the trunks are connected together by insertion; the first socket 10 and the second socket 20 are mechanically and electrically connected together; and the first socket 10' used for expansion and the other second socket 20 are mechanically and electrically connected together. After the second conductive contact 50 of the second socket 20 is connected by insertion to the first conductive contact 30' of the first socket 10' used for expansion, a current from a power plug 30 can be transmitted to the other second socket 20. The string lights 64 can be electrically connected to the power supply contact 40. All conductor wires are arranged and wired outside the trunk; as a result, the connection is quick and convenient. A flexible wire is used to have the power supply contact 40 arranged; therefore, the connection of the string lights is quicker and more convenient, and manufacturing processes of the first socket and the second socket are greatly simplified.

The descriptions of the utility model are made with reference to the above specific embodiments; however, it is apparent that those skilled in the art can make various replacements, modifications, and changes according to the above contents. Therefore, all these replacements, improvements, and changes fall within the spirit and scope of the appended claims.

What is claimed is:

1. A combined power socket for an artificial Christmas tree, the combined power socket comprising:

a first socket and a second socket, wherein each of the first socket and the second socket comprises an annular structure capable of being sleeved on an outer surface and in physical contact with the entire circumference of a rod or tube;

a plurality of openings formed therethrough from a first end to a second end of the first socket, with conductive contacts being arranged within the plurality of openings;

a plurality of conductive pins formed on a first end of the second socket and configured to be received in the plurality of openings; and a plurality of conductive wires in electrical connection with either the conductive contacts or the conductive pins, the conductive wires extending from outer sidewalls of either the first socket or the second socket;

wherein a first pair of the plurality of conductive wires extend between either the first socket or the second socket and an additional socket; and wherein a second pair of the plurality of conductive wires extend from either the first socket or the second socket to a power plug.

2. The combined power socket according to claim 1, wherein either the first socket or the second socket further comprises a plurality of blades extending outwardly and are configured to be arranged proximate to a ring body of the other of the first socket and the second socket such that the first and second sockets are detachably connected together.

3. The combined power socket according to claim 2, wherein the first socket comprises:

an annular substrate;

an annular inner wall and an annular outer wall perpendicular to the substrate having an inner circumference and an outer circumference, respectively, and extending toward a first side of the substrate;

an annular cover plate connected to first ends of the inner wall and the outer wall to seal a space enclosed by the substrate, the inner wall, and the outer wall;

wherein the plurality of blades extend along the inner wall toward a second side of the substrate; and a plurality of pillars extending from the substrate, wherein the plurality of openings are formed on the substrate radially at ends of the plurality of pillars; and wherein the conductive contacts are electrically connected to the plurality of conductive wires extending from either the first socket or the second socket.

4. The combined power socket according to claim 3, wherein the plurality of blades include four blades distributed uniformly and symmetrically about the substrate; and eight openings distributed uniformly and symmetrically about the substrate, wherein each opening of the eight openings is arranged adjacent to a side of one of the four blades, wherein four openings forming a group, and conductive contacts in the openings of the same group are electrically connected.

5. The combined power socket according to claim 4, wherein the conductive contacts are metal tubes in a size matching an inner diameter of the openings and ends of the metal tubes in the openings of the same group facing the cover plate are electrically connected through an arc-shaped conductive tube, conductive rod, or conductive metal wire.

6. The combined power socket according to claim 3, wherein the ring body connects the outer surfaces of the blades and the pillars, and a height of the ring body is the same as a height of the pillars but less than a height of the blades, such that the blades exceed the ring body and extend farther toward the second side of the substrate.

7. The combined power socket according to claim 6, wherein the second socket comprises:

an annular second substrate;

an annular second inner wall and an annular second outer wall perpendicular to the substrate having an inner circumference and an outer circumference, respectively, and extending toward a first side of the second substrate;

an annular second cover plate connected to first ends of the second inner wall and the second outer wall to seal a space enclosed by the second substrate, the second inner wall, and the second outer wall;

a plurality of second blades extending along the second outer wall toward a second side of the second substrate; and a plurality of second pillars extending along the outer wall toward the first side of the second substrate; and wherein the plurality of conductive pins are insertable into the plurality of openings and being electrically connected to the plurality of conductive wires extending from the second socket.

8. The combined power socket according to claim 7, wherein four second blades are distributed uniformly and symmetrically about the second substrate; four second pillars are distributed uniformly and symmetrically about the second substrate, and each second pillars is arranged adjacent to one of the second blades.

9. The combined power socket according to claim 8, wherein the second side of the second substrate is further provided with a second ring body connecting outer surfaces of the second blades and the second pillars, and a height of the second ring body is the same as a height of the second pillars but less than a height of the second blades, such that the second blades exceed the second ring body and extend farther toward the second side of the second substrate.

10. The combined power socket according to claim 1, wherein the first socket is sleeved on a lower-layer section of a trunk of the Christmas tree, the second socket is sleeved on an upper-layer section of the trunk of the Christmas tree, and the first socket and the second socket are electrically connected when the upper-layer section and the lower-layer section are connected together.

* * * * *